US006927701B2

(12) United States Patent
Schmidt et al.

(10) Patent No.: US 6,927,701 B2
(45) Date of Patent: Aug. 9, 2005

(54) RUNWAY OCCUPANCY MONITORING AND WARNING

(75) Inventors: Noel E Schmidt, Bloomington, MN (US); Kirk J Swanson, Chanhassen, MN (US); Eric R Chartier, Saint Louis Park, MN (US)

(73) Assignee: Architecture Technology Corporation, Minneapolis, MN (US)

( * ) Notice: Subject to any disclaimer, the term of this patent is extended or adjusted under 35 U.S.C. 154(b) by 101 days.

(21) Appl. No.: 10/354,257

(22) Filed: Jan. 29, 2003

(65) Prior Publication Data

US 2004/0145499 A1 Jul. 29, 2004

(51) Int. Cl.[7] ..... G08B 21/00

(52) U.S. Cl. ..... 340/959; 340/945; 340/948; 340/961; 340/972; 340/981; 340/988

(58) Field of Search ..... 340/959, 945, 340/948, 961, 972, 981, 990, 988, 905; 701/14, 15, 17, 120, 301

(56) References Cited

U.S. PATENT DOCUMENTS

| | | | | |
|---|---|---|---|---|
| 4,845,629 A | * | 7/1989 | Murga | 701/120 |
| 5,268,698 A | * | 12/1993 | Smith et al. | 342/450 |
| 5,374,932 A | * | 12/1994 | Wyschogrod et al. | 342/36 |
| 5,462,429 A | | 10/1995 | Pritchard et al. | |
| 5,519,618 A | | 5/1996 | Kastner et al. | |
| 5,548,515 A | | 8/1996 | Pilley et al. | |
| 5,629,691 A | | 5/1997 | Jain | |
| 5,740,047 A | | 4/1998 | Pilley et al. | |
| 5,867,804 A | | 2/1999 | Pilley et al. | |
| 6,006,158 A | | 12/1999 | Pilley et al. | |
| 6,195,609 B1 | | 2/2001 | Pilley et al. | |
| 6,282,488 B1 | | 8/2001 | Castor et al. | |
| 6,314,363 B1 | * | 11/2001 | Pilley et al. | 701/120 |
| 6,381,541 B1 | | 4/2002 | Sadler | |
| 6,462,697 B1 | | 10/2002 | Klamer et al. | |
| 2002/0093433 A1 | | 7/2002 | Kapadia et al. | |
| 2002/0109625 A1 | | 8/2002 | Gouvary | |

OTHER PUBLICATIONS

"Inductive Loop Technology LSS Blind Spot Surveillance," http://www.airscene.com/loops.html, Nov. 2002.

"Theory of Operation of Detector Technologies," http://ntl.bts.gov/DOCS/96100/ch05/body_ch05.html.

"3D Multilateration," Roke Manor Research Limited, http://www.roke.co.uk/sensors/positioning/3d_multilateration.asp, 1998.

"Airports Increase Multilateration Surveillance—Air Traffic Management Article," GST, Inc., http://www.navsource.com/Articles/Multilateration/multilateration.html, 2001.

(Continued)

*Primary Examiner*—Hung Nguyen
(74) *Attorney, Agent, or Firm*—Shumaker & Sieffert, P.A.

(57) ABSTRACT

Techniques are described for monitoring runway occupancy and providing an indication of occupancy of a runway to an airplane on final approach the runway. A system, for example, defines and monitors one or more zones on the runway to determine whether the runway is occupied. Such a system includes sensors, such as inductive loop sensors, that may be located proximate to or on the runway, and the system may monitor ingress and egress of objects, such as airplanes or other vehicles on the ground, into and out of the zone in order to determine whether the zone is activated. The sensors may be located at points of entry and exit for the zone. The zones may be located at take-off hold areas of the runway and intersections of the runway with taxiways. A ground-based approach light array of the system may provide the indication of runway occupancy to the airplane.

52 Claims, 8 Drawing Sheets

OTHER PUBLICATIONS

William Reynish, "Will Multilateration Become Mainstream," Avionics Magazine, http://www.defensedaily.com/reports/avionics/previous/0601/0601multilateration.htm, Jun. 2001.

Vern Edwards et al., "Inductive Loop Sensor Subsystem (LSS) as a Supplemental Surface Surveillance System—Demonstration Results," AIAA 19$^{th}$ Annual Digital Avionics Systems Conference, IEEE, 2000.

Vern Edwards et al., "Inductive Loop Technology (LOT) as an Alterative Surface Surveillance System—Demonstration Results," AIAA 18$^{th}$ Annual Digital Avionics Systems Conference, IEEE, 1999.

Technical Proposal—FAA BAA Phase II Response Regarding Technologies Aimed at Increasing Safety on Airport Movement Areas–Pulsing–PAPI, Siemens Airfield Solutions Inc., Attachment 4, 2000.

* cited by examiner

RUNWAY OCCUPANCY MONITORING AND WARNING

TECHNICAL FIELD

The invention relates to airport traffic monitoring, and more particularly, to monitoring and reporting ground traffic on a runway of an airport.

BACKGROUND

A runway occupancy conflict occurs when an obstruction, e.g., airplane or ground vehicle, is located on a runway during final approach by an airplane that is cleared to land on the runway. If the obstruction located on the ground does not vacate the runway, and the approaching airplane does not abort the final approach, the two vehicles may collide. At a minimum, such a collision can lead to serious damage to or destruction of the airplanes or vehicles involved, and a disruption of the operation of the airport. Such a collision can also lead to the serious injury or death of occupants of the airplanes or vehicles involved.

Air traffic controllers, who direct airplanes and vehicles on the ground and airplanes in the air, are primarily responsible for preventing runway occupancy conflicts. However, air traffic controllers occasionally err by, for example, clearing a first plane to take-off on a runway or taxi across the runway, and clearing a second plane to land on the same runway. Further, pilots occasionally are mistaken as to which runway they have been cleared to taxi across, take off on, or land on. As major hub airports become increasingly large and busy, the potential for air traffic controller and pilot errors of this nature increases. Further, some smaller airports are non-towered, i.e., do not have air traffic controllers.

Even when errors of this nature occur, a collision may be avoided by the pilot on final approach. A pilot on final approach is trained to scan the length of the runway for potential obstructions. If an obstruction is present, the pilot may decide whether to continue with the final approach, call the tower for additional information, and/or abort the final approach and execute a go-around. However, obstructions on the runway may be difficult for pilots to see, especially at night or in poor visibility weather conditions. Further, final approach is a high workload time for pilots, and the level of attention a pilot can devote to scanning the runway may not be adequate in certain situations.

SUMMARY

In general, the invention provides techniques for monitoring runway occupancy, and providing an indication of occupancy of a runway to an airplane on final approach to the runway, allowing a pilot of the airplane time to react to a avoid a potentially deadly collision with the object on the runway. More specifically, a system is described that monitors one or more defined zones on the runway to determine whether the runway is occupied. The zones may be defined for "hot" areas of a runway, e.g., areas of ingress and egress for the runway, such as take-off hold areas of the runway and intersections of the runway with taxiways or other runways.

Such a system includes sensors, such as inductive loop sensors, that may be located proximate to or on the runway. The sensors may, for example, be located at points of entry and exit for the zones, and the system may monitor ingress and egress of objects, such as airplanes or other vehicles on the ground, into and out of each zone in order to determine whether the zones are activated. The system may also monitor the areas defined by the zones to determine whether the zones are activated.

The system may use a variety of techniques to distinguish between objects that pose a collision threat to the airplane on final approach, and objects whose occupation of a zone on the runway is transitory. A zone may be determined to be activated when the occupation of a zone by an object poses a collision threat. The system may provide an indication of runway occupancy based on the determination that a zone on the runway is activated.

A ground-based approach light array of the system may provide the indication of runway occupancy to the airplane. The light array may be a Precision Approach Path Indicator (PAPI) or Visual Approach Slope Indicator (VASI) light array. The system may provide the indication by flashing the light array.

In one embodiment, the invention is directed to a method in which a zone is defined on a runway at a region of ingress and egress for the runway. The zone is monitored to determine whether the zone is activated. An indication of runway occupancy is provided to an airplane on final approach to the runway based on the determination. The zone may, for example, be monitored by monitoring ingress of objects into and egress of objects from the zone, or by monitoring an area defined by the zone.

In another embodiment, the invention is directed to a system that includes a sensor and a controller coupled to the sensor. The controller monitors a zone defined on a runway at a region of ingress and egress for the runway via the sensor to determine whether the zone is activated. Based on the determination, the controller provides an indication of runway occupancy to an airplane on final approach to the runway.

In another embodiment, the invention is directed to a computer-readable medium containing instructions. The instructions cause a programmable processor to monitor a zone defined on a runway at a region of ingress and egress for the runway via at least one sensor to determine whether the zone is activated. The instructions further cause a programmable processor to provide an indication of runway occupancy to an airplane on final approach to the runway based on the determination.

In another embodiment, the invention is directed to a method in which a point of entry and a point of exit for a zone on an airport runway are defined. At least one activation sensor is located at the point of entry, and at least one deactivation sensor is located at the point of exit. The ingress of objects to the zone is sensed via the activation sensor, and the egress of objects from the zone is sensed via the deactivation sensor. Whether the zone is activated is determined based on the sensed ingress of objects into and egress of objects from the zone. An indication of runway occupancy is provided to an airplane on final approach to the runway via a ground-based approach light array based on the determination.

In another embodiment, the invention is directed to a system that includes an activation sensor located proximate to an entry point for a zone on a runway, a deactivation sensor located proximate to an exit point of the zone, and a ground-based light array. The system further includes a controller coupled to the sensors and the light array. The controller senses the ingress of objects into the zone via the activation sensor and the egress of objects from the zone via the deactivation sensor. The controller determines whether the zone is activated based on the sensed objects, and provides an indication of runway occupancy to an airplane on final approach to the runway via the light array.

The invention may provide advantages. For example, by providing an indication of runway occupancy to an airplane on final approach to a runway, such a system may allow a pilot of an airplane on final approach to avoid a potentially/deadly collision of the airplane with an object on the runway. The pilot may avoid the collision by, for example, aborting the final approach and executing a go-around.

Moreover, the described techniques do not require any procedural changes for the pilots or air traffic controllers. In many cases, the techniques may automatically warn the pilots without interrupting the air traffic controllers, and may allow the pilot to respond without contacting the tower for additional guidance. Thus, use of the invention does not increase air traffic controller workload. The invention can also be used at smaller airports without air traffic controllers.

Use of a ground-based approach light array to provide an indication of runway occupancy to a pilot of an airplane on final approach may provide advantages. Because such a light array may be visible to a pilot of an airplane on final approach to a runway in poor visibility conditions and is within the field of attention of the pilot, a system according to the invention may be able to effectively indicate that the runway is occupied to the pilot via the light array, allowing the pilot to avoid a potentially deadly collision with an object on the runway. Use of a light array to indicate runway occupancy may reduce the cost of such as system by avoiding more expensive ground-to-air communications systems. Further, use of an existing light array, such as a PAPI or VASI light array, may further reduce the cost of such as system.

Where a PAPI or VASI light array is used, the attention of the pilot on final approach is already drawn to lights. Pilots may easily learn to interpret the new signals indicated by an existing light array. For example, pilots may easily learn that a flashing PAPI or VASI indicates that the runway is occupied.

Such a system may be able to effectively determine the occupancy of runways without including more elaborate or numerous sensors required to monitor the entire area of runways, reducing the cost of such a system to municipalities, or other entities that manage airports. Instead such a system may effectively determine runway occupancy by monitoring selected zones or problem areas where objects on the ground, such as airplanes and other vehicles, are likely to be located when they pose a collision threat to an airplane on final approach. Further, such a system may determine whether zones are occupied without using more complex and expensive sensors and subsystems that identify the location of objects on the ground, such as multilateration or GPS based sensors and subsystems, which often require the installation of a specialized transponder, transmitter, emitter, sensor, or the like, on each object on an airfield. Such a system can also avoid indicating that a runway is occupied in situations where the occupation of a zone is transient and does not pose a collision threat to an airplane on final approach, such as when an airplane that is taking-off or landing on the runway passes through the zone.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
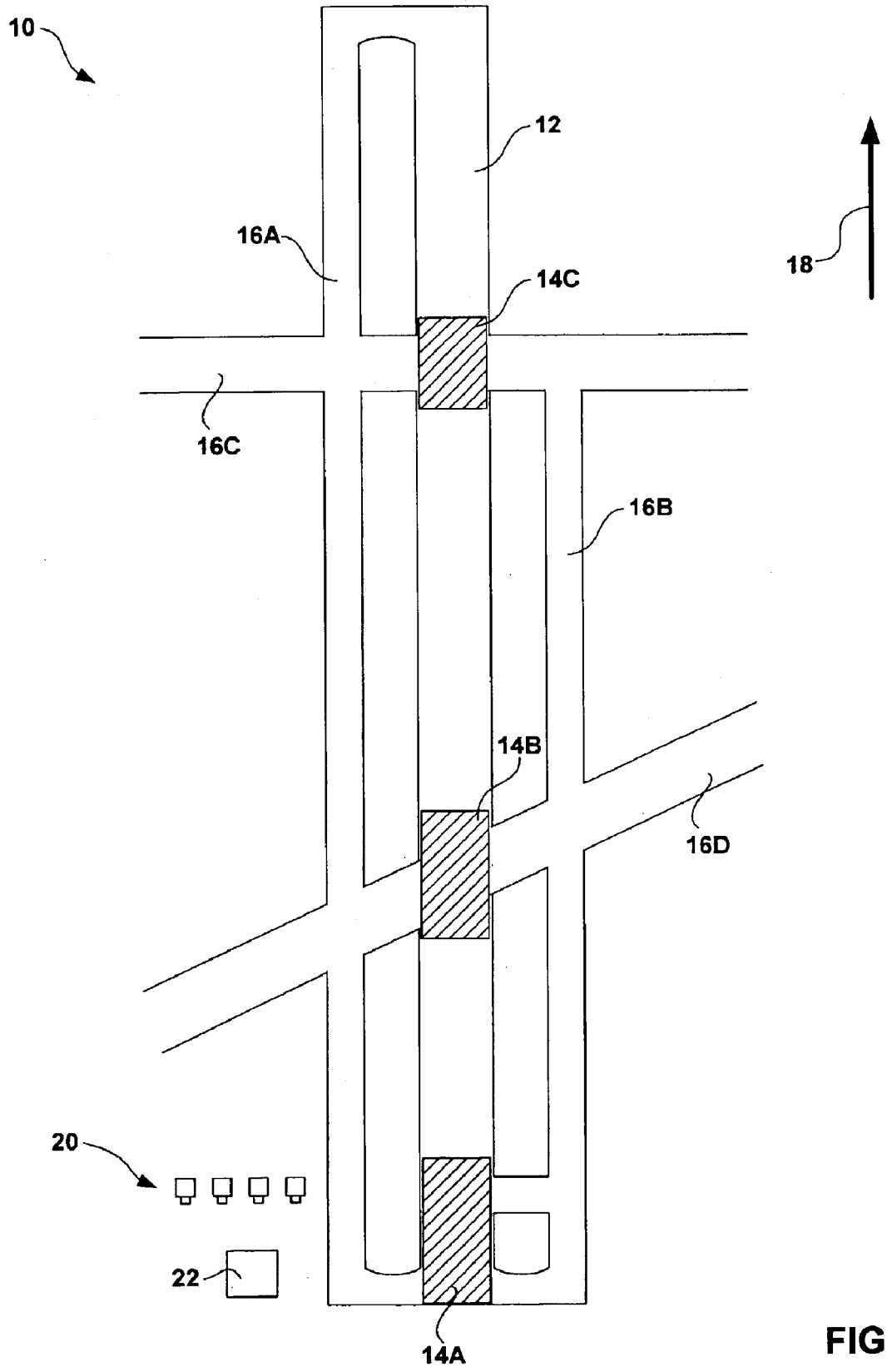
FIG. 1 is a perspective diagram illustrating an example airfield on which occupancy of a runway may be monitored by a system in accordance with the invention.

FIG. 1 is a perspective diagram illustrating an example airfield 10 on which occupancy of a runway 12 may be monitored by a system according to the invention. As will be described in greater detail below, a system according to the invention defines and monitors the occupancy of zones 14A–C (collectively "zones 14") on runway 12, and determines whether runway 12 is occupied based on the occupancy of zones 14. Such a system may monitor the occupancy of zones 14 by monitoring the ingress and egress of objects (not shown) on the ground, e.g., airplanes or other vehicles, into and out of zones 14, or by monitoring the areas defined by zones 14.

A system according to the invention also provides an indication of runway occupancy to an airplane on final approach (not shown). By providing an indication of runway occupancy to an airplane on final approach, such a system may allow a pilot of the approaching airplane to avoid a potentially deadly collision of the airplane with an object on runway 12. The pilot may avoid the collision by, for example, aborting the final approach and executing a go-around. The pilot could also contact an air traffic controller via radio in response to the indication. The pilot could receive instruction from the air traffic controller, and/or the air traffic controller may instruct the operator of the object on the ground, e.g., the pilot of an airplane or driver of a vehicle, to move the object off of runway 12.

In addition to runway 12, airfield 10 includes taxiways 16A–D (collectively "taxiways 16") that intersect with and/or provide access to runway 12. Zones 14 may, as shown in FIG. 1, be located at intersections of taxiways 16 with runway 12, and at areas of runway 12 where taxiways 16 provide access to runway 12. Thus, zones 14 may be located at the areas on runway 12 where objects on the ground enter, exit and cross runway 12.

For example, zone 14A is shown in FIG. 1 as including a take-off hold area of runway 12 for large airplanes. Generally, large airplanes cleared to the take-off hold area by an air traffic controller prior to take-off would taxi on one of taxiways 16A and 16B, enter zone 14A, and hold in zone 14A until cleared for take-off by the air traffic controller. When cleared for take-off by the air traffic controller, the airplanes accelerate on runway 12 in direction 18 and take-off. Zone 14B includes a take-off hold area of runway 12 for smaller airplanes. Zones 14B and 14C include the intersection of runway 12 with taxiways 16D and 16C, respectively, where airplanes and other vehicles may cross runway 12.

Thus, zones 14, as shown in FIG. 1, include areas of runway 12 where objects on the ground, such as airplanes and other vehicles, are likely to be located when they pose a collision threat to an airplane on final approach. For example, an airplane awaiting take-off within a take-off hold area included within one of zones 14A and 14B poses a collision threat to an airplane on final approach so long as it occupies that zone 14A or 14B. When the airplane on the ground begins to accelerate in direction 18 to take off, leaving that zone 14A or 14B, the airplane on the ground no longer poses a collision threat to the airplane on final approach. Similarly, an airplane or vehicle taxiing across runway 12 on one of taxiways 16C and 16D poses a collision threat to an airplane on final approach so long as the airplane or vehicle occupies zone 14B and 14C.

By monitoring the occupancy of zones 14 located as shown in FIG. 1, a system according to the invention may be able to effectively determine whether runway 12 is occupied, i.e., whether an object on runway 12 poses a collision threat to an aircraft on final approach. Such a system may be able to effectively determine the occupancy of runway 12 without including more elaborate or numerous sensors required to monitor the entire area of runway 12, reducing the cost of such a system to municipalities, or other entities that manage airports. However, the configuration of airfield 10 and the locations of zones 14 on runway 12 are merely exemplary. A system according to the invention may monitor the occupancy of any number of runways 12 on an airfield 10 with runways 12 and taxiways 16 configured in any manner, by monitoring the occupancy of any number of zones 14 of any size and shape, located anywhere on the runways 12. For example, a system according to the invention may monitor the occupancy of a zone 14 that includes substantially all of the surface area of a runway 12.

An exemplary way by which a system according to the invention may provide an indication that runway 12 is occupied to an airplane on final approach is by providing a visual indication of runway occupancy via a ground-based approach light array 20. Light array 20 is visible to a pilot of an airplane on final approach as it approaches runway 12 traveling in direction 18. Light array 20 may be a Precision Approach Path Indicator (PAPI) light array, Visual Approach Slope Indicator (VASI) light array, or any light array that is visible to a pilot of an approaching airplane.

In general, PAPI and VASI light arrays provide visual guidance information to a pilot on approach to land. In particular, the color of the lights of a PAPI or VASI light array indicates the angle of an airplane on final approach to the pilot of the approaching airplane. A system according to the invention may indicate that to an airplane on final approach that runway 12 is occupied by, for example, flashing light array 20. Light array 20 may be electrically coupled to and controlled by a control unit 22, which may, for example include a modified Siemens Air Solutions Land and Hold-Short Operations (LAHSO) power control unit that provides power to light array 20 and a programmable switch that is controllable to cause light array 20 to flash or remain steady.

Because light array 20 may be visible to a pilot of an airplane on final approach to runway 12 in poor visibility conditions and is within the field of attention of the pilot, a system according to the invention may be able to effectively indicate that runway 12 is occupied to the pilot via light array 20, allowing the pilot to avoid a potentially deadly collision with an object on runway 12. Use of light array 20 to indicate runway occupancy may reduce the cost of such as system by avoiding more expensive ground-to-air communications systems. Use of an existing light array 20, such as a PAPI or VASI light array, may further reduce the cost of such as system.

The configuration of light array 20 shown in FIG. 1 is merely exemplary. For example, light array 20 may include any number of lights arranged in any manner. Moreover, a system according to the invention is not limited to use of PAPI or VASI light arrays 20, or to use of light array 20 at all. For example, any type of existing light array may be used to indicate runway occupancy, or a light array dedicated to indicating runway occupancy may be used. Instead of or in addition to indicating runway occupancy via light array 20, a system according to the invention may indicate to a pilot of an airplane on final approach that runway 12 is occupied via radio communication with the pilot, e.g., via an audible warning on a radio of the approaching airplane, or by wirelessly directing a computer onboard the airplane on final approach to provide a visual or audible warning to the pilot, e.g., via flashing lights or an alarm.

Figure 2:
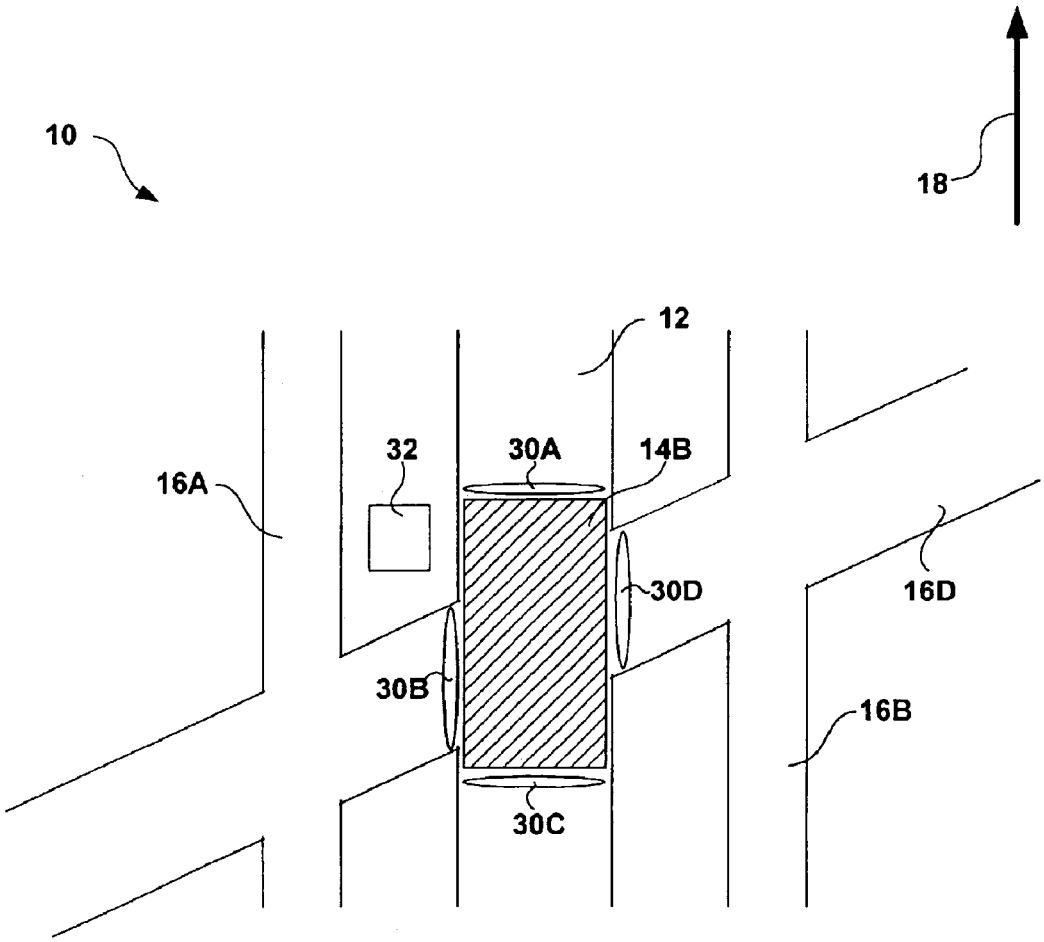
FIG. 2 is a perspective diagram illustrating an example configuration of sensors that may be used by a system according to the invention to monitor activation of a zone on the runway of FIG. 1.

FIG. 2 is a perspective diagram illustrating an example configuration of sensors 30A–D (collectively "sensors 30") that may be used by a system according to the invention to monitor occupancy of zone 14B on runway 12. In this example, sensors 30 are inductive loop sensors. Loop sensors 30 may be placed in saw cuts in taxiway 16D and runway 12 proximate to zone 14B, and electrically coupled to an inductive loop detector 32. Loop detector 32 may, for example, be a 3M Canoga Inductive Loop Detector.

Loop detector 32 may detect when an airplane, vehicle, or other object crosses one of loop sensors 30. In particular, when an airplane or other vehicle crosses one of loop sensors 30, loop detector 32 may detect an inductance change via the loop sensor 30. As shown in FIG. 2, loop sensors 30 may be located at points on runway 12 and taxiway 16D where airplanes and other vehicles enter and exit zone 14B, and may be dimensioned such that an airplane or other vehicle would likely cross a sensor 30 when entering or exiting zone 14B. Thus, loop detector 32 is able to detect the ingress and egress of airplanes and other vehicles into and out of zone 14B via loop sensors 30 configured as shown in FIG. 2, and the configuration of loop sensors 30 in effect defines a monitored perimeter for zone 14B.

In this manner, a system according to the invention may be able to determine the occupancy of zones 14 on runway 12 by monitoring the ingress and egress of airplanes and other vehicles into and out of zones 14 via loop detectors 32 and loop sensors 30 along the perimeters of the zones. For example, an airplane or other vehicle may taxi on taxiway 16D and enter zone 14B by crossing loop sensor 30B. Loop detector 32 will detect that the airplane or other vehicle has crossed loop sensor 30B, and a system according to the invention may determine that zone 14B is occupied in response to the sensor detection. The airplane or vehicle may later exit zone 14B by crossing any of loop sensors 30. For example, an airplane may be cleared to take-off and cross loop sensor 30A as the airplane accelerates on runway 12 in direction 18, or an airplane or vehicle may cross loop sensor 20D as it completes taxiing across runway 12. Loop detector 32 will detect the subsequent crossing of a loop sensor 30, and such a system may determine that zone 14B is no longer occupied based on the subsequent detection.

A system according to the invention may provide an indication that runway 12 is occupied to an airplane on final approach by, for example, flashing light array 20 (FIG. 1) during the period that the system has determined that zones 14B is occupied. However, it may be desirable for the system to avoid indicating that runway 12 is occupied in situation where the occupation of a zone 14 is transient and does not pose a collision threat to an airplane on final approach, such as when an airplane that is taking-off or landing on runway 12 passes through zone 14B crossing loop sensors 30A and 30C. In order to avoid indicating occupancy of runway 12 in such situations, the system may, for example, distinguish between loop sensors 30B and 30D, across which an airplane or object may enter a zone in a manner that poses a collision threat, and loop sensors 30A and 30C. The system may also avoid indicating occupancy of runway 12 in such situations by comparing a timer value to the period of time that a zone 14 has been occupied in order to determine whether that zone 14 has been occupied for a sufficient period of time such that the occupation poses a collision threat. A zone 14 that is occupied by an object that poses a collision threat may be referred to as "activated." The logic that may be employed by a system to determine the activation of zones 14 based on sensor detections will be described in greater detail below.

By using loop sensors 30, a system according to the invention may determine whether zones 14 are activated without using more complex and expensive sensors and subsystems that identify the location of objects on the ground, such as multilateration or GPS based sensors and subsystems, which require the installation of a specialized transponder, transmitter, emitter, sensor, or the like, on each object on an airfield 10. However, the invention is not limited to systems that include loop sensors 30. A system according to the invention may include other sensors, such as magnetometers, motion detectors, or acoustic locators, and use these sensors to determine whether zones 14 are activated as described herein.

A system according to the invention may also include still other sensors, such as electromagnetic beam sensors that use visible, ultraviolet, infrared, microwave, or other electromagnetic radiation to detect objects. In general, however, electromagnetic beam sensors will detect wheels of an object, and additional logic known in the art will be required to identify an object based on multiple detections of the wheels of the object. Some sensors that may be used, such as motion detectors, may be capable of detecting the ingress and egress of objects in and out of zones 14 in addition to airplanes and vehicles, such as people or animals. Further, any number of sensors, with any sized or shaped detection areas, configured in any way may be used by a system to determine whether zones 14 are activated.

Figure 3:
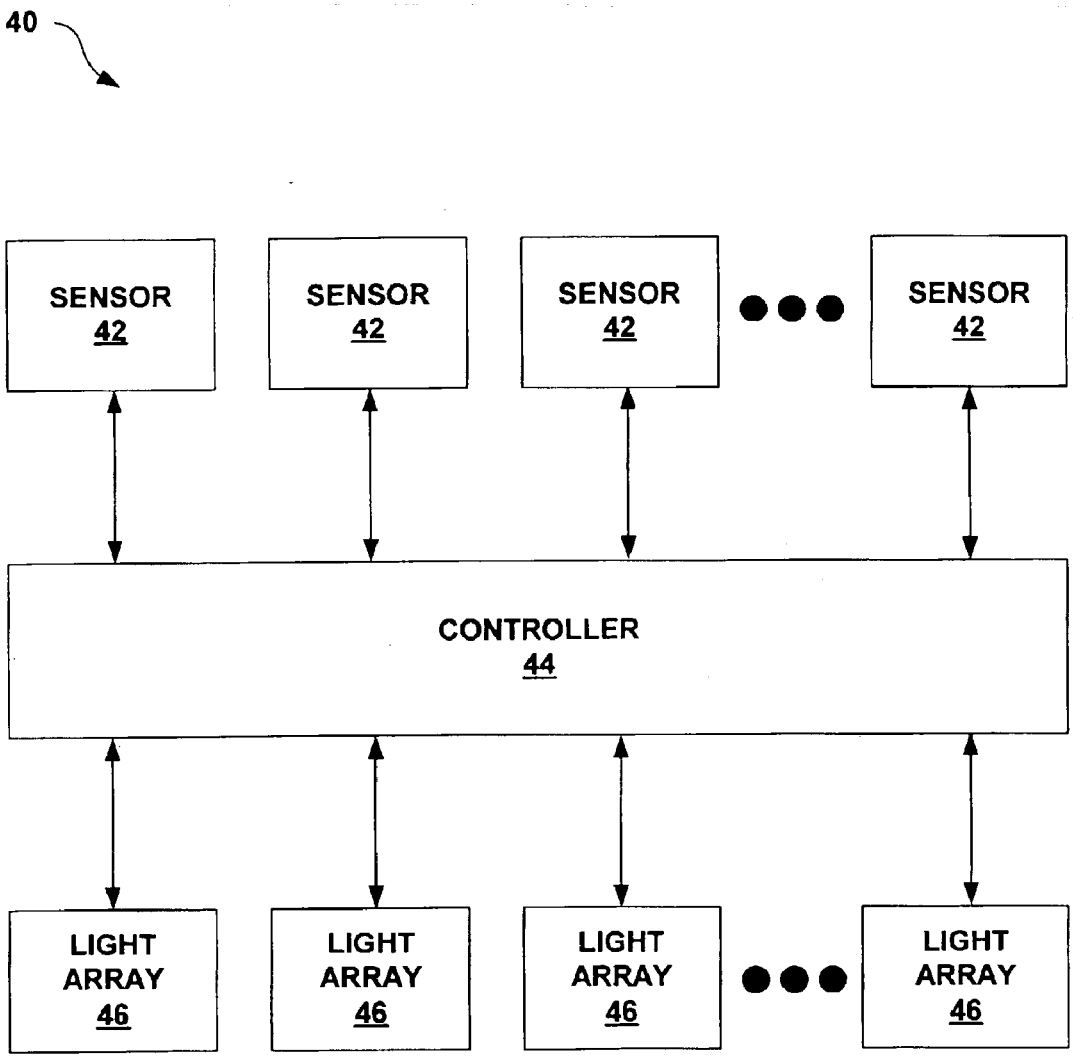
FIG. 3 is a block diagram illustrating an example system to determine whether one or more runways are occupied, and to provide an indication of runway occupancy to an airplane on final approach to an occupied runway based on the determination.

FIG. 3 is a block diagram illustrating an example system 40 for determining whether one or more runways 12 are occupied and providing an indication of runway occupancy to an airplane on final approach to an occupied runway 12 based on the determination. As shown in FIG. 3, system 40 includes a number of sensors 42. Sensors 42 may, as described above, be positioned to define zones 14 on runways 12. For example, sensors 42 may be placed on runways 12 and taxiways 16 such that at least one sensor 42 detects each object that enters or exits zones 14. Sensors 42 may include loop sensors 30, or other sensors, such as magnetometers, motion detectors, acoustic locators, electromagnetic beam sensors, or the like, as described above.

As shown in FIG. 3, sensors 42 communicate with a controller 44. Controller 44 detects whether an object has crossed the detection field of sensors 42 based on signals received from sensors 42. For example, where sensors 42 include loop sensors 30, controller 44 may detect whether an object has crossed the detection field of a loop sensor 30 based on an inductance change, as described above. Controller 44 includes appropriate detection circuitry to process signals received from sensors 42, and determine whether objects have crossed the detection field of sensors 42 based on the signals. For example, where sensors 42 include loop sensors 30, controller 44 may include one or more loop detectors 32 that are each associated with one or more loop sensors 32 to process the signals generated by the loop sensors 32.

Controller 44 also includes a microprocessor, digital signal processor (DSP), application specific integrated circuit (ASIC), field programmable gate array (FPGA), programmable logic controller (PLC), or other logic circuitry programmed to process indications of sensor detections output by the detection circuitry in order to determine whether zones 14 are activated and provide an indication of runway occupancy to an airplane on final approach based on the determination. In some embodiments, system 40 may provide an indication of runway occupancy to an airplane on final approach via light arrays 46, which may include light arrays 18 described above. In such embodiments, the microprocessor, DSP, ASIC, FPGA, or the like of controller 44 include light array control units, such as control unit 22 described above, which may be controlled by the microprocessor, DSP, ASIC, FPGA, or the like to activate or flash an appropriate one of light arrays 46 depending on which zone 14 of which runway 12 is determined to be occupied. In order to perform the functions ascribed to controller 44 herein, the microprocessor, DSP, ASIC, FPGA, or the like of controller 44 may execute program code stored in a memory that may include any of a variety of electrical, magnetic, or optical media, such as a RAM, ROM, CD-ROM, magnetic disk, magnetic tape, EEPROM, or the like.

The various components of controller 44 need not be collocated. For example, detection circuitry, such as loop detectors 32, may be located in a number of physical boxes, each box located near a zone 14 and receiving signals from the sensors 42 that monitor that zone 14. The microprocessor, DSP, ASIC, FPGA, or the like of controller 44 may be located in one of these boxes, in a box that contains a power control unit for a light array 46, or, more commonly, in a location separate from both of these components. Where the microprocessor, DSP, ASIC, FPGA, or the like of controller 44 is located separate from the other components, it may be coupled to the using an appropriate wired or wireless connection. For example, the microprocessor, DSP, ASIC, FPGA, or the like of controller 44 may be coupled to the other components via radio modems coupled to each component. Where controller 44 includes a microprocessor, the microprocessor may be a central processing unit of a computing device, such as a server, that receives indications of sensor 42 detections from the detection circuitry via radio modem, processes the sensor 42 detections to determine occupancy of zones 14, and controls a power control unit associated with an appropriate light array 46 to activate or flash the appropriate light array 46 via radio modem based on the determination.

Figure 4:
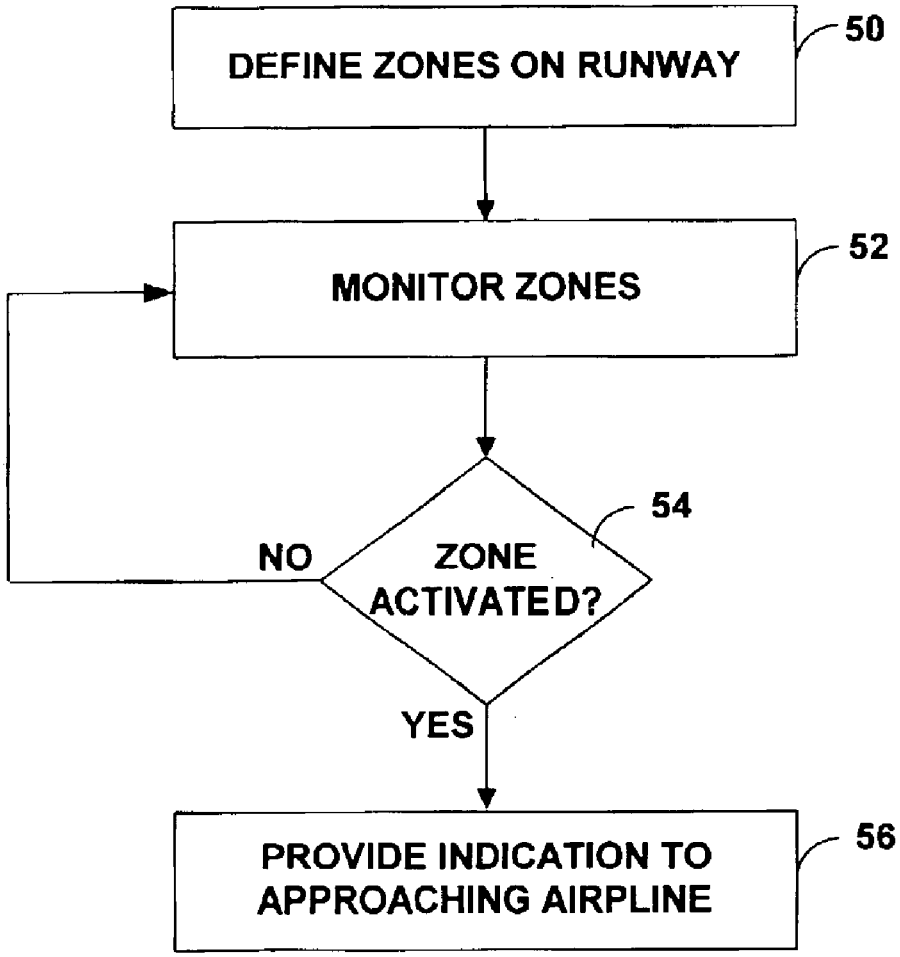
FIG. 4 is a flowchart illustrating an example method of determining whether one or more runways are occupied and providing an indication of runway occupation to an airplane on final approach to an occupied runway based on the determination.

FIG. 4 is a flowchart illustrating an example method of determining whether one or more runways 12 are occupied and providing an indication of runway occupation to an airplane on final approach to an occupied runway 12 based on the determination. One or more zones 14 are defined on runways 12 by, for example, placing one or more sensors 42 along perimeters for the zone or within identified ingress and egress areas for the zones (50). Next, controller 44 monitors zones 14 by, for example, monitoring the ingress and egress of objects on the ground, such as airplanes and other vehicles, into and out of the zones 14 via sensors 42, which may include inductive loop sensors 30 (52). For example, a microprocessor, or the like, of controller 44 may receive indications when objects cross the detection fields of sensors 42, indicating which sensor 42 was crossed, from detection circuitry of controller 44 associated with the sensors 42. Where sensors 42 include loop sensors 30, the detection circuitry of controller 44 may include loop detectors 32.

Controller 44 determines whether any of the zones are activated (54). Controller 44 may make this determination based on the ingress and egress of objects into and out of zones 14. If no zones 14 are activated, controller 44 continues to monitor zones 14 (52). If one of zones 14 is activated, controller 44 provides an indication of runway occupancy to an airplane on final approach to the runway 12 with the activated zone 14 (56). Controller 44 may provide this indication by activating or flashing a light array 46 for the runway 12 with the activated zone 14.

Figure 5:
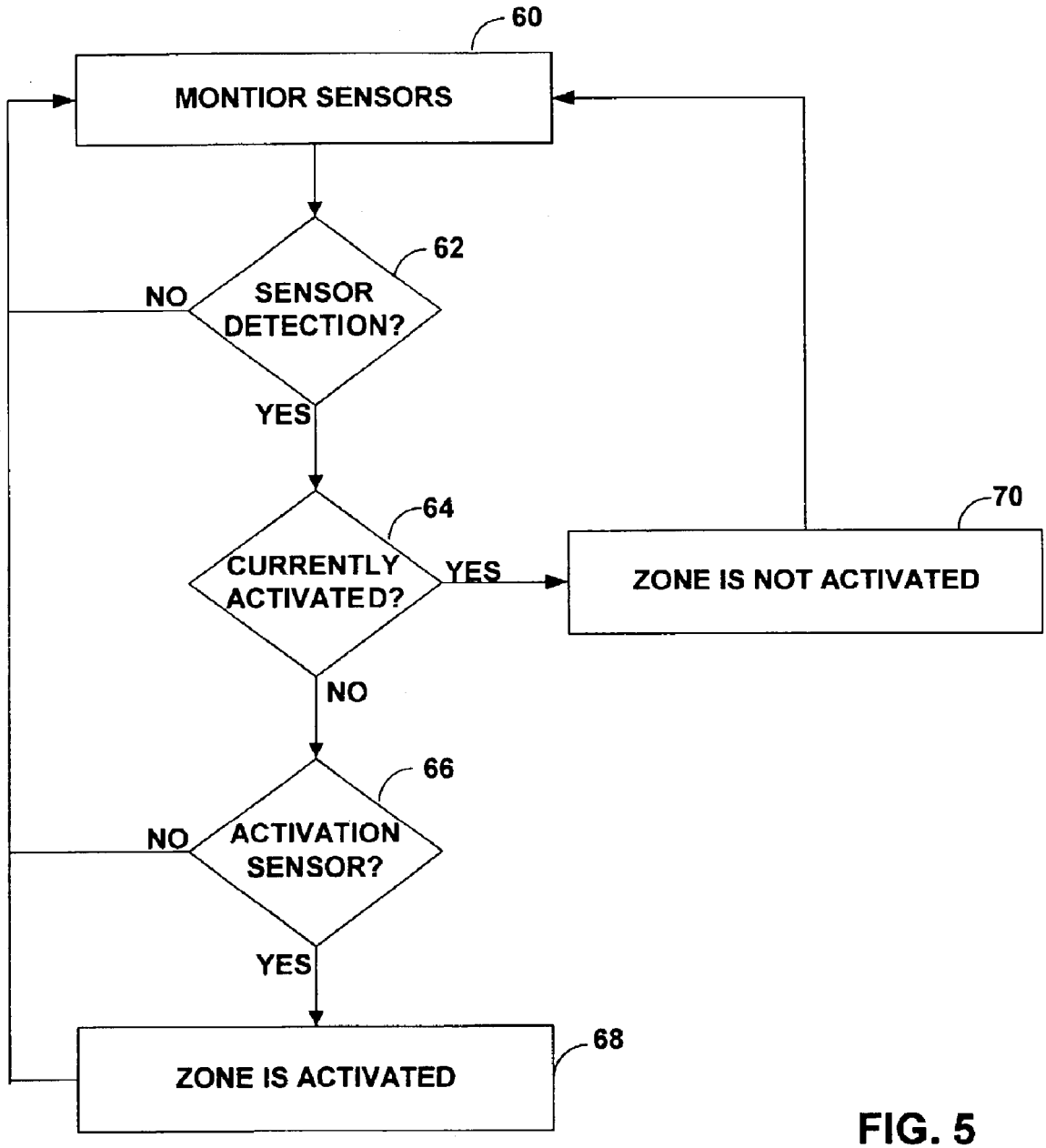
FIG. 5 is a flowchart further illustrating the method of FIG. 4 according to an example embodiment of the invention.

FIG. 5 is a flowchart further illustrating the method of FIG. 4 according to an example embodiment of the invention. In particular, FIG. 5 illustrates an exemplary method that may be employed by controller 44 to determine whether a zone 14 on a runway 12 is activated based on the ingress and egress of objects into and out of the zone 14. As described above, controller 44 monitors the ingress and egress of objects out of zones 14 by monitoring sensors 42 that define zones 14 (60).

When controller 44 determines that an object has crossed a sensor 42 (62) for a particular zone 14, controller 44 may determine whether that zone 14 was activated prior to the sensor detection (64). At initialization of system 40, controller 44 may assume that the defined zones 14 are not activated. As described above, a microprocessor, or the like, of controller 44 may receive indications when objects cross the detection fields of sensors 42, indicating which sensor 42 was crossed, from detection circuitry of controller 44 associated with the sensors 42.

If the zone 14 associated with the crossed sensor 42 was not previously activated, controller 44 may determine whether the sensor 42 crossed was an activation sensor 42 that indicates an object has entered zone 14 (66). As described above, in order to avoid indicating occupancy of a runway 12 in situations where the transient occupation of a zone 14 by an object does not propose a collision threat, controller 44 may distinguish between activation and deactivation sensors 42 for the zones 14. For example, for the zone 14 illustrated in FIG. 2, controller 44 may designate loop sensors 30B and 30D, across which an airplane or object may enter a zone in a manner that poses a collision threat, as activation sensors. Similarly, controller 44 may designate loop sensors 30A and 30C as deactivation sensors as these sensors monitor exit points for the defined zone 14.

If controller 44 determines that the particular zone 14 was previously not activated and that an activation senor 42 associated with that zone 14 was crossed, controller 44 will determine that the zone 14 associated with the activation sensor 42 is now activated (68) and provide an indication of runway occupancy to an airplane on final approach (56) (FIG. 4). If controller 44 determines that the particular zone 14 associated with the crossed sensor 42 was previously not activated, but that the crossed sensor 42 was a deactivation sensor 42, controller 44 will determine that the zone 14 is still not activated. If the zone 14 associated with the crossed sensor 42 was previously activated when the sensor 42 was crossed, controller 44 will determine that the zone is no longer activated regardless of whether the crossed sensor 42 was an activation or deactivation sensor (70), and will discontinue providing an indication of runway occupancy, by, for example, stopping a light array 46 from flashing.

Figure 6:
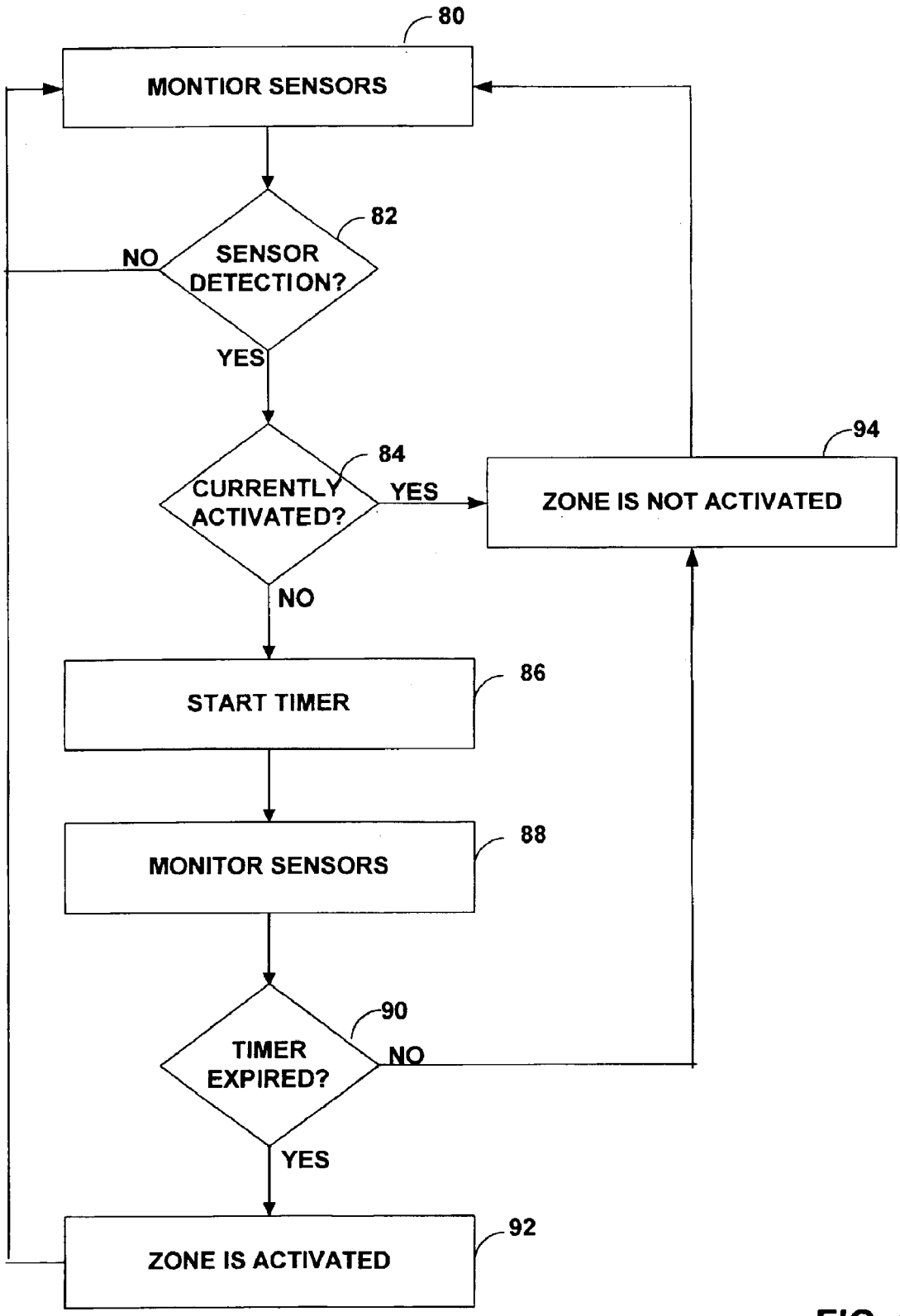
FIG. 6 is a flowchart further illustrating the method of FIG. 4 according to another example embodiment of the invention.

FIG. 6 is a flowchart further illustrating the method of FIG. 4 according to another example embodiment of the invention. In particular, FIG. 6 illustrates another method that may be employed by controller 44 to avoid indicating occupancy of a runway 12 in situations where a transient occupation of a zone 14 by an object does not propose a collision threat. Controller 44 monitors sensors 42 (80), determines whether sensors 42 have been crossed (82), and determines whether the zone 14 associated with the crossed sensor 42 was previously activated (84), as described above.

In this embodiment, when controller 44 determines that a sensor 42 associated with a previously not activated zone 14 has been crossed, controller 44 will start a timer (86) and continue to monitor sensors 42 (88). If controller 44 determines that the timer has expired before a subsequent detection for a sensor 42 associated with the same zone 14 (90), controller 44 will determine that the occupation of that zone 14 is not transient and poses a collision threat to an airplane on final approach, i.e., that the zone 14 is activated (92). After the timer expires, controller 44 may provide an indication of runway occupancy to an airplane on final approach (56) (FIG. 4). If the zone 14 was previously determined to be activated before a sensor detection, or the timer did not expire before the subsequent detection, controller 44 will determine that the zone 14 is not activated (94).

Figure 7:
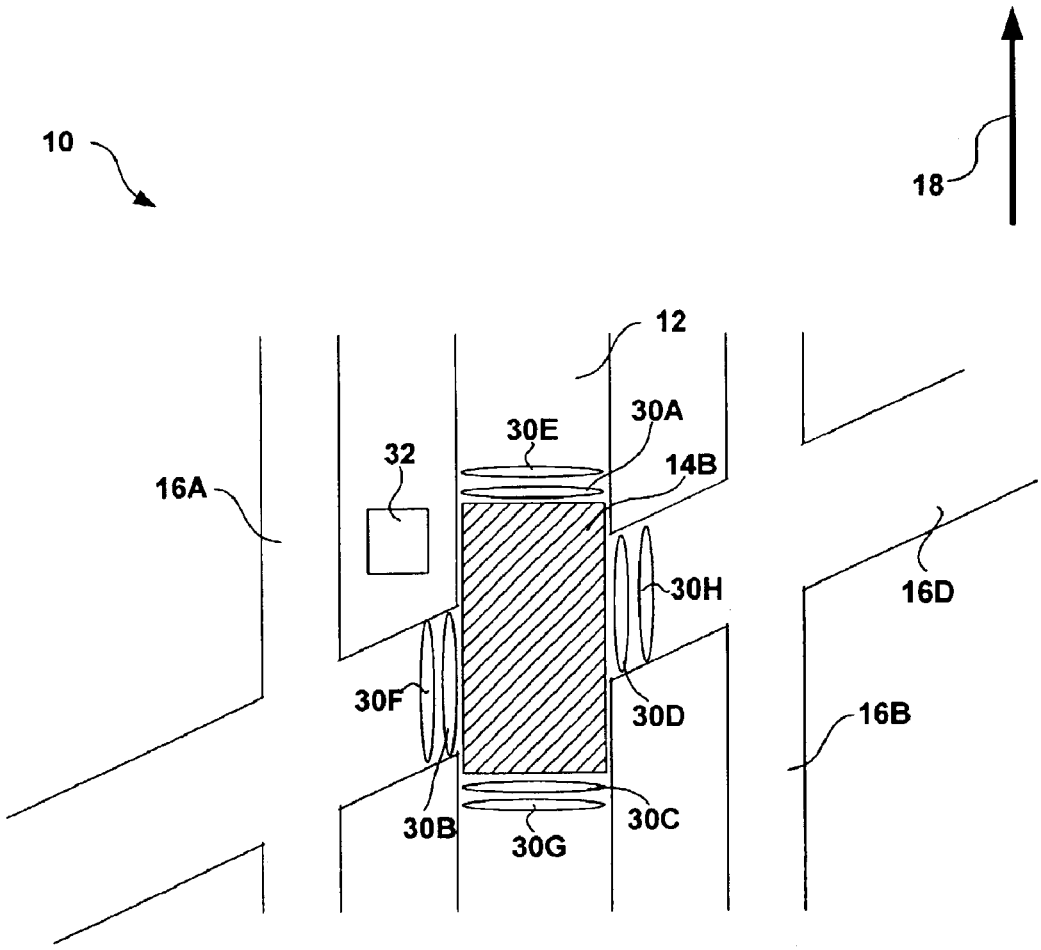
FIG. 7 is a block diagram illustrating another example configuration of sensors to monitor activation of a zone on the runway of FIG. 1.

FIG. 7 is a block diagram illustrating another example configuration of loop sensors 30 to monitor activation of zone 14B on runway 12. As shown in FIG. 7, system 40 may utilize two or more sensors 42 at each point of entry and exit of a zone 14, such as loop sensors pairs 30A and 30E, 30B and 30F, 30C and 30G and 30D and 30H, at the various points of entry and exit to zone 14B. Using two or more sensors 42 may allow system 40 to determine the direction that an object is moving, i.e., whether the object is entering or exiting the zone 14. By determining whether the object is entering or exiting the zone 14, system 40 may be able to better determine whether the zone 14 is activated in instances where two or more objects may simultaneously occupy the zone 14.

Figure 8:
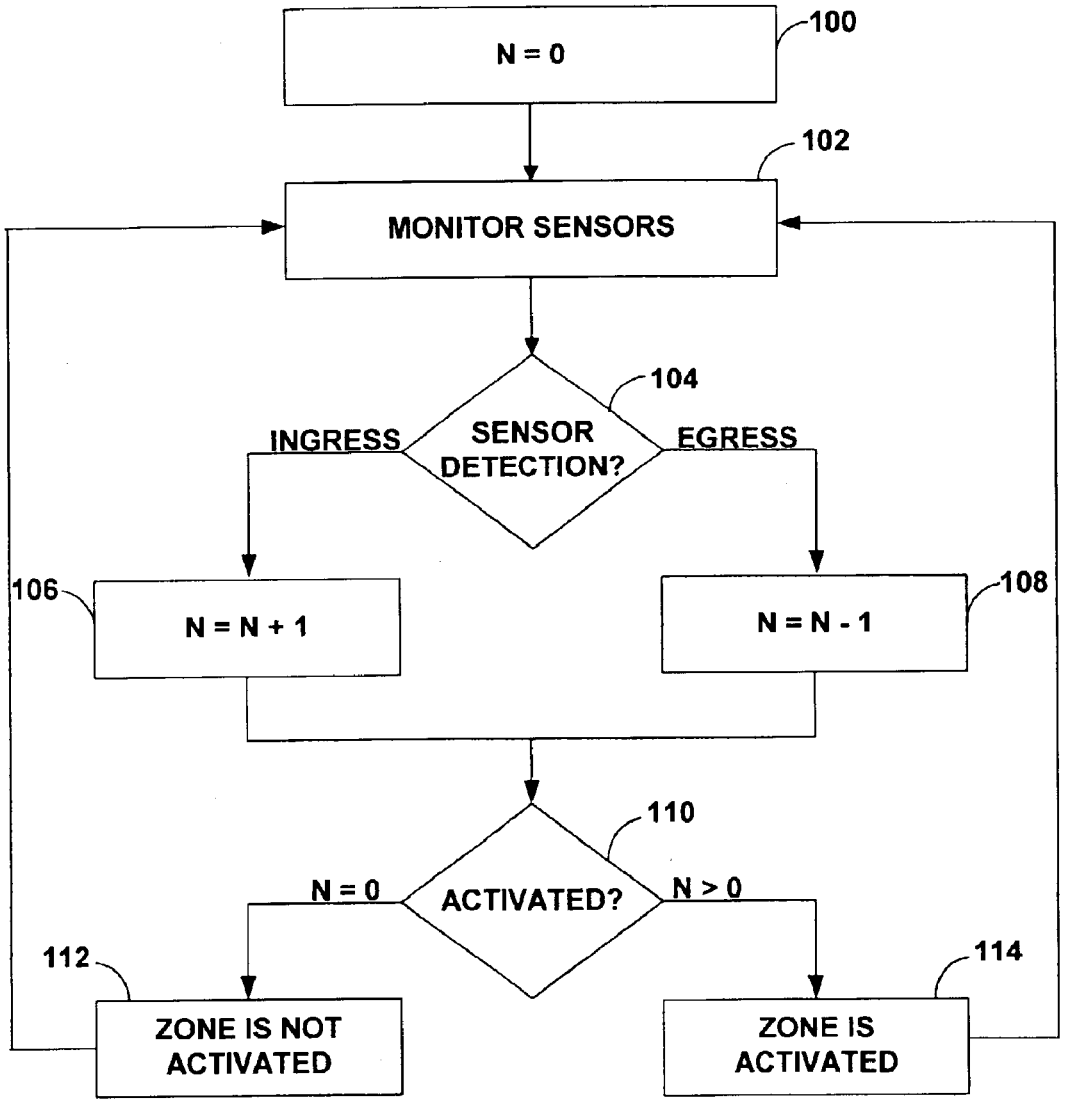
FIG. 8 is a flowchart further illustrating the method of FIG. 4 according to another example embodiment of the invention.

FIG. 8 is a flowchart further illustrating the method of FIG. 4 according to another example embodiment of the invention. In particular, FIG. 8 illustrates a method that may be applied by system 40 to determine whether a zone 14 is activated when system 40 is able to determine whether an object is entering or exiting the zone 14. The method of this embodiment allows system 40 to determine the number of objects in the zone 14.

For each zone 14, controller 44 may maintain a variable N representing the number of objects in the zone 14. The variable N for each zone is initially set to a value of zero (100). Controller 44 monitors sensors 42 (102), and upon each sensor detection will determine whether the object is entering or leaving the zone 14 (104), and increment or decrement the variable N appropriately (106–108). Controller 44 may determine whether a zone is activated based on whether the value of N is greater than zero (110–114).

Controller 44 may also use a timer to avoid indicating activation of a runway 12 in situations where a transient occupation of a zone 14 by an object does not propose a collision threat. For example, controller 44 may determine whether the value of N has exceeded zero for some period of time before providing an indication of runway occupancy.

Various embodiments of the invention have been described. These embodiments are illustrative of the practice of the invention. Various modifications may be made without departing from the scope of the claims. For example, although a system according to the invention has been primarily described above with respect to embodiments that monitor a zone by monitoring a perimeter of the zone and the ingress and egress of objects into and out of the zone, a system according to the invention may additionally or alternatively monitor an area defined by the zone to determine whether the zone is activated.

Such embodiments of a system may include sensors 42, such as inductive loop sensors 30, that are located within the area defined by the zone and are able to detect the presence of objects within the area defined by the zone. In order to avoid indicating occupancy of a runway 12 in situations where a transient occupation of a zone 14 by an object does not pose a collision threat, a controller 44 of such a system may, for example, determine whether a first sensor 42 to detect the object is an activation sensor located at an entry point for the zone. A controller 44 of such a system may additionally or alternatively start a timer upon detection of the object by a first sensor 42 that monitors the area, and determine whether any sensor 42 that monitors the area continues to detect the object upon expiration of the timer.

Additionally, a system according to the invention may include or cooperate with additional sensors, such as a radar system, to determine whether a plane is on final approach when a zone is determined to be occupied. The system may provide an indication of runway occupancy, by for example flashing a light array, only when it determined that a plane is actually on final approach. These and other embodiments are within the scope of the following claims.

What is claimed is:

1. A method comprising:

defining a zone on a runway at a region of ingress and egress for the runway;

defining a point of entry and a point of exit for the zone;

locating at least one sensor at the point of entry and at least one sensor at the point of exit for the zone;

monitoring ingress of objects to the zone via the sensor located at the point of entry for the zone and egress of objects from the zone via the sensor located at the point of exit for the zone to determine whether the zone is activated; and providing an indication of runway occupancy to an airplane on final approach to the runway based on the determination of whether the zone is activated.

2. The method of claim 1, wherein monitoring ingress and egress of objects to determine whether the zone is activated comprises:

detecting an object via one of the sensors; and determining whether the zone was not activated prior to detecting the object.

3. The method of claim 1, wherein monitoring ingress and egress of objects to determine whether the zone is activated comprises:

detecting an abject via one of the sensors; and determining whether the sensor is an activation sensor.

4. The method of claim 1, wherein monitoring ingress and egress of objects to determine whether the zone is activated comprises:

detecting an object via a first one of the sensors; and determining whether a timer has expired before detecting the object via one of the first one of the sensors and a second one of the sensors.

5. The method of claim 1, wherein monitoring ingress and egress of to determine whether the zone is activated comprises determining a number of objects in the zone.

6. The method of claim 5, wherein determining a number of objects in the zone comprises:

detecting objects via pairs of sensors located at points of entry and exit for the zone;

determining an order in which the sensors of the pairs detect the objects; and determining whether detected objects are entering or exiting the zone based on the order of detection.

7. The method of claim 1, wherein monitoring ingress of objects to the zone and egress of objects from the zone comprises monitoring an area defined by the zone.

8. The method of claim 7, wherein monitoring an area defined by the zone to determine whether the zone is activated comprises:

detecting an object within the area; and determining whether a first sensor to detect the object is an activation sensor.

9. The method of claim 7, wherein monitoring an area defined by the zone to determine whether the zone is activated comprises:

detecting an object within the area;

starting a timer upon detecting the object; and determining whether the zone is occupied upon expiration of a timer.

10. The method of claim 7, wherein at least one of the sensors is located within the area defined by the zone.

11. The method of claim 1, wherein monitoring the zone to determine whether the zone is occupied by at least one of airplanes and ground-based vehicles.

12. The method of claim 1, wherein the zone is located on at least one of a take-off area of the runway, an intersection of the runway with a taxiway, and an intersection of the runway with another runway.

13. The method of claim 1, wherein monitoring ingress of objects to the zone and egress of objects from the zone comprises monitoring the zone via at least one of an inductive loop sensor, a magnetometer, a motion detector, an acoustic locator, and an electromagnetic beam sensor.

14. The method of claim 1, wherein providing an indication of runway occupancy comprises providing an indication of runway occupancy via a ground-based approach light array.

15. The method of claim 14, wherein providing an indication of runway occupancy via a ground-based approach light array comprises providing an indication of runway occupancy via at least one of a precision approach path indicator light array and a visual approach slope indicator light array.

16. The method of claim 14, wherein providing an indication of runway occupancy via a ground-based approach light array comprises flashing the light array.

17. A system comprising:

a first sensor located proximate to an entry point for a zone defined on a runway at a region of ingress and egress for the runway;

a second sensor located proximate to an exit point for the zone; and a controller coupled to the first and second sensors to monitor ingress of objects to the zone via the first sensor and egress of objects from the zone via the second sensor to determine whether the zone is activated, and provide an indication of runway occupancy to an airplane on final approach to the runway based on the determination of whether the zone is activated.

18. The system of claim 17, wherein the controller detects an object via one of the first and second sensors, and determines whether the zone is activated by determining whether the zone was not activated prior to detecting the object.

19. The system of claim 17, wherein the controller detects an object via one of the first and second sensors, and determines whether the zone is activated by determining whether the sensor is an activation sensor.

20. The system of claim 17, wherein the controller detects an object via the first sensor and determines whether the zone is activated by determining whether a timer has expired before detecting the object via one of the first and second sensors.

21. The system of claim 17, wherein the controller determines a number of objects in the zone.

22. The system of claim 21, further comprising pairs of sensors located at each point of entry and exit for the zone, wherein one of the pairs includes the first sensor and another of the pairs includes the second sensor, and the controller determines the number of objects in the zone by detecting objects via the pairs of sensors, determining an order in which the sensors of the pairs detect the objects, and determining whether detected objects are entering or exiting the zone based on the order of detection.

23. The system of claim 17, wherein the controller monitors the zone by monitoring an area defined by the zone.

24. The system of claim 23, wherein the controller monitors the zone by detecting an object within the area, starting a timer upon detecting the object, and determining whether the zone is occupied upon expiration of a timer.

25. The system of claim 23, wherein at least one of the first and second sensors is located within the area defined by the zone.

26. The system of claim 17, wherein the controller monitors the zone to determine whether the zone is occupied by least one of airplanes and ground-based vehicles.

27. The system of claim 17, wherein the zone is located on at least one of a take-off area of the runway, an intersection of the runway with taxiway, and an intersection of the runway with another runway.

28. The system of claim 17, wherein at least one of the first and second sensors includes one of an inductive loop sensor, a magnetometer, a motion detector, an acoustic locator, and an electromagnetic beam sensor.

29. The system of claim 17, further comprising a ground-based approach light array, wherein the controller provides an indication of runway occupancy to an airplane on final approach via the ground-based approach light array.

30. The system of claim 29, wherein the light array comprises at least one of a precision approach path indicator light array and a visual approach slope indicator light array.

31. The system of claim 29, wherein controller provides an indication of runway occupancy by controlling the light array to flash.

32. A computer-readable medium comprising instructions that cause a processor to:

monitor ingress of objects to a zone defined on a runway at a region of ingress and egress for the runway via at least one sensor located at a point of entry for the zone and egress of objects from the zone via at least one sensor located at a point of exit for the zone to determine whether the zone is activated; and provide an indication of runway occupancy to an airplane on final approach to the runway based on the determination of whether the zone is activated.

33. The computer-readable medium of claim 32, wherein the instructions that cause a processor to monitor ingress and egress of objects to determine whether a zone is activated comprise instructions that cause a processor to detect an object via at least one of the sensors and determine whether the zone was not activated prior to detecting the object.

34. The computer-readable medium of claim 32, wherein the instructions that cause a processor to monitor ingress and egress of objects to determine whether a zone is activated comprise instructions that cause a processor to detect an object via at least one of the sensors and determine whether the sensor is an activation sensor.

35. The computer-readable medium of claim 32, wherein the instructions that cause a processor to monitor ingress and egress of objects to determine whether a zone is activated comprise instructions that cause a processor to detect an object via a first one of the sensors and determine whether a timer has expired before detecting the object via one of the first one of the sensors and a second one of the sensors.

36. The computer-readable medium 32, wherein the instructions that cause a processor to monitor ingress and egress of objects to determine whether a zone is activated comprise instructions that cause a processor to determine a number of objects in the zone.

37. The computer-readable medium of claim 36, wherein the instructions that cause a processor to determine a number of objects in the zone comprise instructions that cause a processor to:

detect objects via pairs of sensors located at each point of entry and exit for the zone;

determine an order in which the sensors of the pair detect the objects; and determine whether detected objects are entering or exiting the zone based on the order of detection.

38. The computer-readable medium of claim 32, wherein the instructions that cause a processor to monitor ingress and egress of objects to determine whether a zone is activated comprise instructions that cause a processor to monitor an area defined by the zone.

39. The computer-readable medium of claim 38, wherein the instructions that cause a processor to monitor an area defined by the zone to determine whether the zone is activated comprise instructions that cause a processor to:

detect an object within the area; and determine whether a first one of the sensors to detect the object is an activation sensor.

40. The computer-readable medium of claim 38, wherein the instructions that cause a processor to monitor an area defined by the zone to determine whether the zone is activated comprise instructions that cause a processor to:

detect an object within the area;

start a timer upon detecting the object; and determine whether the zone is occupied upon expiration of a timer.

41. A method comprising:

defining a point of entry and a point of exit for a zone on an airport runway;

locating at least one activation sensor at the point of entry and at least one deactivation sensor at the point of exit for the zone;

sensing ingress of objects to the zone via the activation sensor and egress of objects from the zone via the deactivation sensor;

determining whether the zone is activated based on the sensed ingress of objects into and egress of objects from the zone; and providing an indication of runway occupancy to an airplane on final approach to the runway via a ground-based approach light array based on the determination of whether the zone is activated.

42. The method of claim 41, wherein determining whether the zone is activated comprises determining whether the zone was not activated prior to detecting the object.

43. The method of claim 41, wherein determining whether the zone is activated comprises:

initiating a timer upon sensing the ingress of an object via the activation sensor; and determining whether the timer expires before detecting the object via the deactivation sensor.

44. The method of claim 41, wherein determining whether the zone is activated comprises:

incrementing an occupancy count upon sensing via the activation sensor an object entering the zone;

decrementing the occupancy count upon sensing via the deactivation sensor an object leaving the zone; and determining that the zone is activated when the occupancy count is greater than zero.

45. The method of claim 41, wherein providing an indication of runway occupancy via a ground-based approach light aray comprises providing an indication of runway occupancy via at least one of a precision approach path indicator light array and a visual approach slope indicator light array.

46. The method of claim 41, wherein providing an indication of runway occupancy via a ground-based approach light array comprises flashing the light array.

47. A system comprising:

an activation sensor located proximate to an entry point for a zone on a runway;

a deactivation sensor located proximate to an exit point for the zone;

a ground-based light array; and a controller coupled to the sensors to sense ingress of objects into the zone via the activation sensor and egress of objects from the zone via the deactivation sensor, determine whether the zone is activated based on the sensed objects, and provide an indication of runway occupancy to an airplane on final approach to the runway via the light array.

48. The system of claim 47, wherein the controller determines whether the zone is activated by determining whether the zone was not activated prior to detecting the ingress of an object.

49. The system of claim 47, wherein the sensor comprises a first sensor, and the controller detects an object via the sensor and determines whether the zone is activated by determining a timer has expired before detecting the object via one of the first sensor and a second sensor.

50. The system of claim 47, wherein the controller determines a number of objects in the zone.

51. The system of claim 47, wherein the light array comprises at least one of a precision approach path indicator light array and a visual approach slope indicator light array.

52. The system of claim 47, wherein controller provides an indication of runway occupancy by controlling the light array to flash.

* * * * *

UNITED STATES PATENT AND TRADEMARK OFFICE

CERTIFICATE OF CORRECTION

PATENT NO. : 6,927,701 B2
APPLICATION NO. : 10/354257
DATED : August 9, 2005
INVENTOR(S) : Noel E. Schmidt, Kirk J. Swanson and Eric R. Chartier It is certified that error appears in the above-identified patent and that said Letters Patent is hereby corrected as shown below:

Col. 11, Line 66, "abject" *should read* "object".

Signed and Sealed this

First Day of August, 2006

JON W. DUDAS
*Director of the United States Patent and Trademark Office*